US010434669B2

(12) United States Patent
Suzuki et al.

(10) Patent No.: US 10,434,669 B2
(45) Date of Patent: Oct. 8, 2019

(54) ELECTRIC SHAVER

(71) Applicant: Panasonic Intellectual Property Management Co., Ltd., Osaka (JP)

(72) Inventors: Ryo Suzuki, Shiga (JP); Kotaro Yanagi, Shiga (JP); Satoshi Sobagaki, Kyoto (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 89 days.

(21) Appl. No.: 15/423,839

(22) Filed: Feb. 3, 2017

(65) Prior Publication Data

US 2017/0225343 A1 Aug. 10, 2017

(30) Foreign Application Priority Data

Feb. 9, 2016 (JP) ..... 2016-022463

(51) Int. Cl.
*B26B 19/38* (2006.01)
*B26B 19/06* (2006.01)
*B26B 19/28* (2006.01)

(52) U.S. Cl.
CPC ..... *B26B 19/063* (2013.01); *B26B 19/28* (2013.01); *B26B 19/386* (2013.01)

(58) Field of Classification Search
CPC ..... B26B 19/386; B26B 19/04; B26B 19/046; B26B 19/048; B26B 19/063; B26B 19/28; B26B 19/38; B26B 19/3853
See application file for complete search history.

(56) References Cited

U.S. PATENT DOCUMENTS

2006/0107530 A1 5/2006 Shimizu
2007/0261249 A1* 11/2007 Yamasaki ..... A45D 26/00 30/43.7

(Continued)

FOREIGN PATENT DOCUMENTS

EP 1661672 A1 5/2006
EP 1854593 A1 11/2007

(Continued)

OTHER PUBLICATIONS

The Extended European Search Report dated Jun. 13, 2017 for the related European Patent Application No. 17153272.4.

*Primary Examiner* — Jason Daniel Prone
*Assistant Examiner* — Samuel A Davies
(74) *Attorney, Agent, or Firm* — McDermott Will & Emery LLP

(57) ABSTRACT

An electric shaver according to the present disclosure includes: a body block having a holding portion; a head portion having a blade portion and supported on the body block to be swingable about a shaft portion; and a connecting member provided for connecting the body block and the head portion to each other. The connecting member is connected to the body block such that the connecting member is movable relative to the body block in an intersecting direction which intersects with an extending direction of the shaft portion, and the connecting member is also connected to the head portion by way of the shaft portion. The connecting member is connected to the body block by way of a resilient member. With such a configuration, it is possible to provide an electric shaver capable of suppressing the generation of abnormal sounds and vibrations while suppressing lowering of a swing performance.

6 Claims, 8 Drawing Sheets

(56) References Cited

U.S. PATENT DOCUMENTS

| | | | | |
|---|---|---|---|---|
| 2010/0175263 | A1* | 7/2010 | Shimizu | B26B 19/048 30/43.92 |
| 2010/0269350 | A1 | 10/2010 | Iwashita | |
| 2011/0094107 | A1* | 4/2011 | Ring | B26B 19/048 30/43.1 |

FOREIGN PATENT DOCUMENTS

| | | | |
|---|---|---|---|
| JP | 2006-149445 | A | 6/2006 |
| JP | 2010-252941 | A | 11/2010 |

* cited by examiner

ELECTRIC SHAVER

RELATED APPLICATIONS

This application is claims the benefit of Japanese Application No. 2016-022463, filed on Feb. 9, 2016, the disclosure of which is incorporated by reference herein.

BACKGROUND

1. Technical Field

The present disclosure relates to an electric shaver.

2. Description of the Related Art

Unexamined Japanese Patent Publication No. 2010-252941 proposes an electric shaver which includes a gripping portion and a head portion swingably supported on the gripping portion.

Such a conventional electric shaver has a unit portion where the head portion and a motor are integrally formed, and the unit portion has a pair of pivot portions. The pair of pivot portions is disposed so as to sandwich the motor in a front-and-back direction. The pair of pivot portions is engaged with a pair of recessed portions formed on the gripping portion, respectively, so that the head portion is supported on the gripping portion to be swingable in a right-and-left direction.

However, in the above-mentioned conventional electric shaver, when the head portion is supported on the gripping portion, due to size tolerance or the like of respective parts, there is concern that, out of the pair of recessed portions formed on the gripping portion, the center axis of one recessed portion is deviated from the center axis of the other recessed portion in the direction intersecting with the axial direction.

In other words, the center axes of the pair of recessed portions may not be disposed on the same straight line.

When the center axes of the pair of recessed portions do not exist on the same straight line, a reaction force caused by axial displacement occurs on the pair of pivot portions when the pair of pivot portions is respectively engaged with the pair of recessed portions.

When the reaction force caused by axial displacement occurs on the pair of pivot portions, there arises a possibility that smooth swinging of the head portion relative to the gripping portion is obstructed and thus a swing performance of the head portion is lowered.

To prevent the generation of the reaction force caused by axial displacement on the pair of pivot portions, it is conceivable to form a gap between the pivot portion and the recessed portion. However, when the gap is formed between the pivot portion and the recessed portion, abnormal sounds or vibrations may be generated at the time of driving the electric shaver.

SUMMARY

The present disclosure has been made to overcome these conventional drawbacks. An object of the present disclosure is to provide an electric shaver capable of suppressing the generation of abnormal sounds and vibrations while suppressing lowering of a swing performance.

To achieve the above-mentioned object, according to one aspect of the present disclosure, there is provided an electric shaver which includes: a body block having a holding portion; a head portion having a blade portion and supported on the body block to be swingable about a shaft portion; and a connecting member which connects the body block and the head portion to each other. The connecting member is connected to the body block such that the connecting member is movable relatively in an intersecting direction which intersects with an extending direction of the shaft portion, and the connecting member is connected to the head portion by way of the shaft portion. The connecting member is connected to the body block by way of a resilient member.

With such a configuration, even when a reaction force caused by axial displacement occurs, the reaction force can be absorbed by the relative movement of the connecting member to the body block in the intersecting direction. Further, the connecting member is connected to the body block by way of a resilient member and hence, the generation of abnormal sounds and vibrations can be suppressed at the time of driving the electric shaver or the like.

According to the present disclosure, it is possible to provide an electric shaver capable of suppressing the generation of abnormal sounds and vibrations while suppressing lowering of a swing performance.

DETAILED DESCRIPTION

Figure 1:
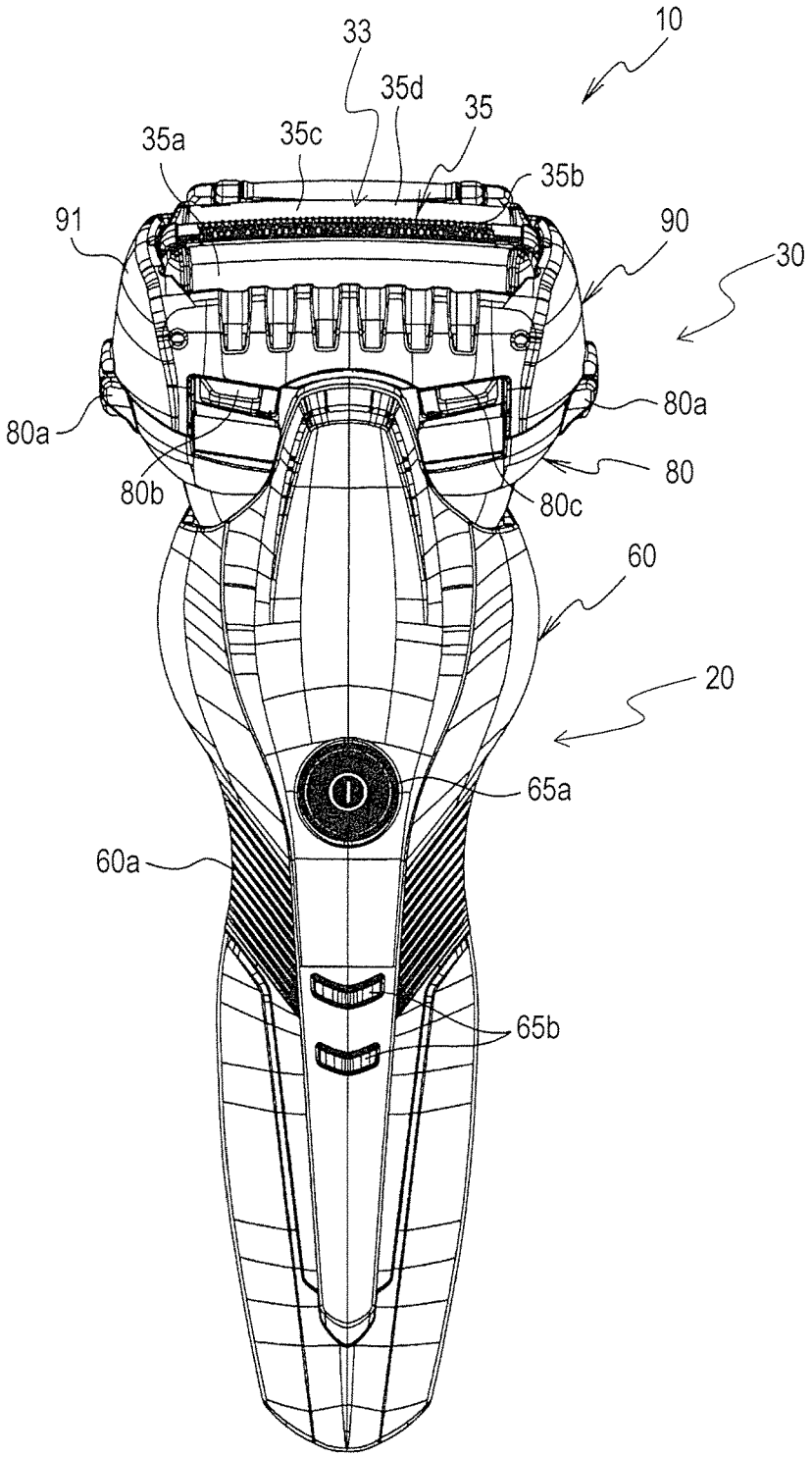
FIG. 1 is a front view showing an electric shaver according to an exemplary embodiment of the present disclosure.

An electric shaver according to an exemplary embodiment of the present disclosure includes: a body block having a holding portion; a head portion which has a blade portion and is supported on the body block to be swingable about a shaft portion; and a connecting member which connects the body block and the head portion to each other. The connecting member is connected to the body block to be relatively movable an intersecting direction which intersects with an extending direction of the shaft portion, and is also connected to the head portion by way of the shaft portion. The connecting member is connected to the body block by way of the resilient member.

With such a configuration, even when a reaction force caused by axial displacement occurs, the reaction force can be absorbed by the relative movement of the connecting member to the body block in the intersecting direction. Further, the connecting member is connected to the body block by way of the resilient member and hence, the generation of abnormal sounds and vibrations can be suppressed at the time of driving the electric shaver or the like.

As viewed in the extending direction of the shaft portion, in a state where the connecting member is connected to the body block, a first gap which allows the relative movement of the connecting member to the body block in the intersecting direction is formed between the connecting member and the body block. The resilient member is disposed in the first gap.

With such a configuration, it is possible to suppress rattling of the connecting member more reliably, while allowing the relative movement of the connecting member to the body block in the intersecting direction.

A first projecting portion which projects in the extending direction of the shaft portion is formed on one of the connecting member and the body block, and a first through hole through which the first projecting portion is inserted is formed on the other of the connecting member and the body block, at a position corresponding the first projecting portion. In a state where the first projecting portion is inserted through the first through hole, a first gap is formed annularly around the first projecting portion.

With such a configuration, it is possible to allow the relative movement of the connecting member to the body block in any arbitrary intersecting direction.

Further, the resilient member is disposed over the entire circumference of the first gap formed annularly.

With such a configuration, it is possible to suppress rattling of the connecting member more reliably, while allowing the relative movement of the connecting member to the body block in any arbitrary intersecting direction.

A second projecting portion which projects in the extending direction of the shaft portion is formed on one of the connecting member and the body block, and a second through hole through which the second projecting portion is inserted is formed on the other of the connecting member and the body block, at a position corresponding to the second projecting portion. A contact portion with which the second projecting portion is brought into contact when the connecting member is moved relative to the body block in the intersecting direction is formed on a peripheral edge portion of the second through hole.

With such a configuration, when a relatively large force is applied to the head portion due to an impact generated when the electric shaver is dropped or the like, for example, a reaction force generated on the connecting member can be dispersed to plural portions and thus a load to the shaft portion disposed between the head portion and the connecting member can be reduced.

As viewed in the extending direction of the shaft portion, the second projecting portion is disposed on either side of the resilient member.

With such a configuration, it is possible to provide the structure for suppressing rattling of the connecting member using the resilient member and the structure for dispersing a reaction force using the second projecting portion, while saving a space for such structures.

In a state where the second projecting portion is inserted through the second through hole, a second gap is formed around the second projecting portion.

Further, the size of the second gap is smaller than the size of the first gap.

Hereinafter, an exemplary embodiment of the present disclosure is described with reference to the drawings. The present disclosure is not limited by the exemplary embodiment.

Hereinafter, the description is made by assuming a direction along which a plurality of outer blades is arranged side by side as a front-and-back direction (shaving direction) X, a direction along which each outer blade extends as a right-and-left direction Y, and an up-and-down direction in a state where the head portion is disposed such that the outer blades are directed upward as an up-and-down direction Z. The description is also made by designating a side where a switch portion of the electric shaver is disposed as a front side in the front-and-back direction X.

Exemplary Embodiment

Electric shaver 10 according to the exemplary embodiment includes, as shown in FIG. 1, body block 20 having holding portion 60*a* which a user grips with his hand, and head portion 30 which has blade portion 33 and is supported by body block 20.

In the exemplary embodiment, head portion 30 is swingable in the right-and-left direction Y with respect to body block 20 using shaft portion 40 extending in the front-and-back direction X as the axis of swinging.

That is, head portion 30 is supported by body block 20 in a swingable manner about shaft portion 40.

Figure 2:
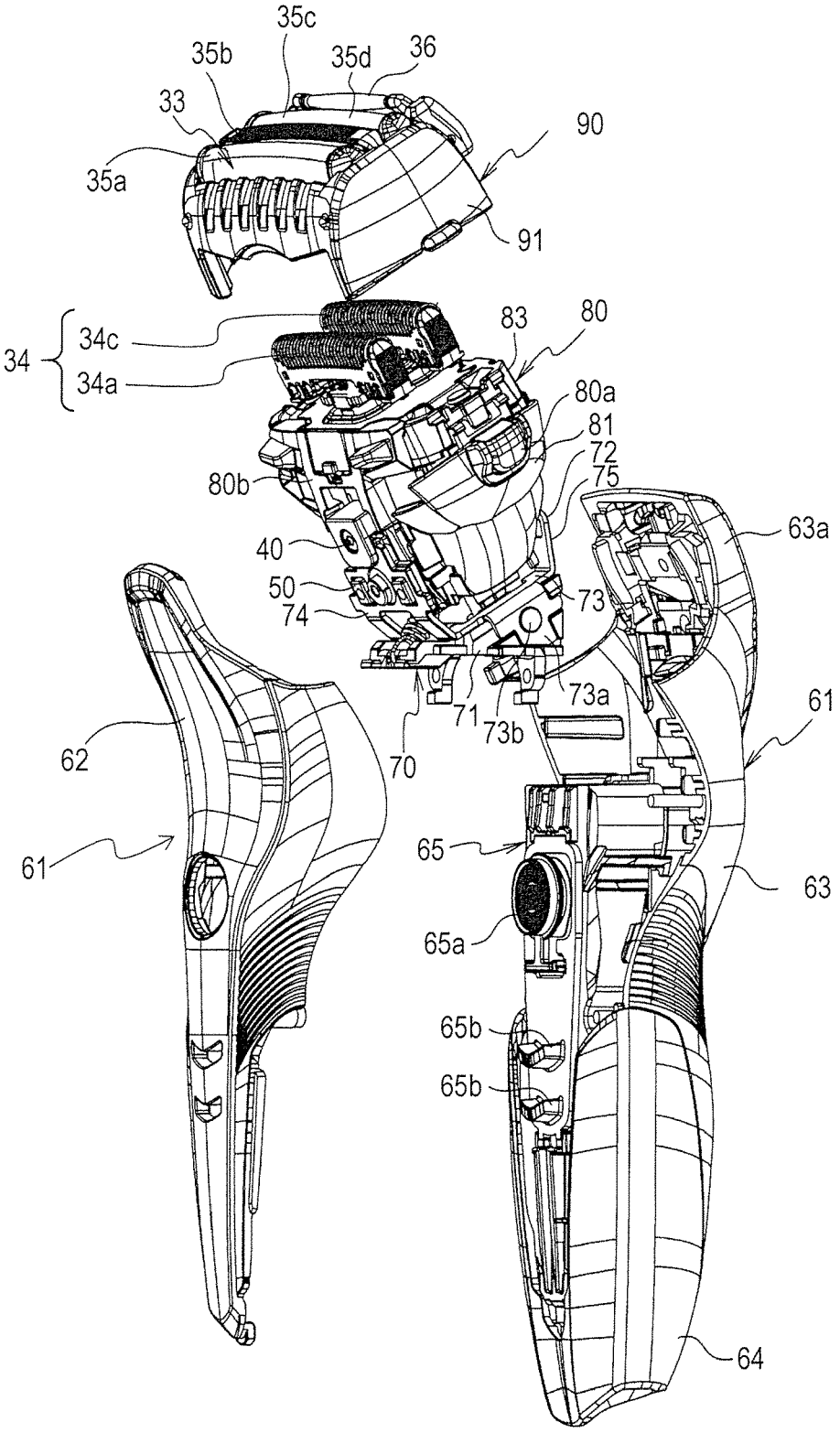
FIG. 2 is an exploded perspective view showing the electric shaver according to the exemplary embodiment of the present disclosure.

As shown in FIG. 2, body block 20 includes: gripping portion (body portion) 60 having holding portion 60*a;* and base portion 70 which is fixed to one end side (upper side in the up-and-down direction Z) of gripping portion 60 to support head portion 30.

Gripping portion 60 includes body housing 61 made of a synthetic resin, and body housing 61 is formed by joining a plurality of split bodies to each other. Further, a cavity is formed inside of body housing 61 which is formed by joining the split bodies to each other, and various electric parts are housed in the cavity. The plurality of these split bodies can be joined to each other by using screws or by causing the split bodies to be fitted to each other, for example.

In the exemplary embodiment, body housing 61 is formed by joining the split bodies such as front housing 62, rear housing 63, and lower housing 64 to each other. A power source device (electric part) 65 formed of a rechargeable battery, a control circuit board and the like (not shown) is housed in a cavity formed between front housing 62 and rear housing 63 (see FIG. 2).

Push-type switch portion 65*a* for operating (turning on or off) electric shaver 10 is formed on body housing 61. In the exemplary embodiment, push-type switch portion 65*a* is exemplified as a switch portion. However, as long as a switch can turn on or off the power source, a slide-type switch or other switches may be used as switch portion 65*a*.

In the exemplary embodiment, switch portion 65*a* is formed on a front surface of front housing 62, that is, on a front surface (front elevational surface) of electric shaver 10. The front surface of electric shaver 10 means a surface of electric shaver 10 on a side where the surface opposedly faces a user in a state where the user grips holding portion 60*a* of electric shaver 10 in normal use.

In the exemplary embodiment, display portion 65*b* is formed below switch portion 65*a* on front housing 62. Display portion 65*b* displays a charged state and the like of the rechargeable battery (not shown) incorporated in the inside of body housing 61.

On a rear portion of rear housing 63, that is, on a rear portion of electric shaver 10, trimmer unit 63*a* is mounted. However, trimmer unit 63*a* may not possibly be mounted.

Blade portion 33 includes: outer blades 35; and inner blades 34 disposed inside outer blades 35 (below outer blades 35).

Outer surfaces of outer blades 35 are exposed toward the upper side of head portion 30, and an exposed portion forms skin contact surface 35*d* which is brought into contact with a user's skin.

In a state where electric shaver 10 is turned on so that inner blades 34 disposed inside outer blades 35 are moved (reciprocated in the right-and-left direction Y) relative to outer blades 35, skin contact surface 35*d* of outer blades 35 is moved while sliding in contact with a user's skin. In such a manner, body hair which enters blade holes of outer blades 35 is cut by outer blades 35 and inner blades 34.

Hereinafter, the specific configuration of head portion 30 and base portion 70 which supports head portion 30 is described.

As shown in FIG. 2, head portion 30 includes: head portion body 80 mounted on base portion 70 (body block 20); and outer blade block 90 detachably mounted on head portion body 80.

Head portion body 80 includes head case 81 and head case cover 83. Head case 81 is opened upward, and is provided with drive mechanism housing portion 82 which houses a drive mechanism (not shown). Head case cover 83 covers an upper opening portion of head case 81 in a state where the drive mechanism is housed inside of drive mechanism housing portion 82 (see FIG. 2 and FIG. 5).

As the drive mechanism, it is possible to use a known drive mechanism, such as a) a vibration-type linear actuator or b) a drive mechanism formed of a rotary motor and a converting mechanism which converts a rotating motion into a reciprocating linear motion, for example.

Further, it is preferable to form drive mechanism housing portion 82 as a waterproof space (sealed space) so as to prevent the intrusion of water used in washing away body hair shaved by blade portion 33 or in cleaning inner blades 34 into the inside of drive mechanism housing portion 82.

On the other hand, as shown in FIG. 2, outer blade block 90 includes outer blade holding member 91 having an approximately cylindrical shape. Outer blades 35 are mounted on outer blade holding member 91 in an upwardly and downwardly movable manner.

In the exemplary embodiment, outer blades 35 include first net blade 35*a*, slit blade 35*b*, and second net blade 35*c*. First net blade 35*a*, slit blade 35*b*, and second net blade 35*c* are disposed in a row in the front-and-back direction X.

That is, on outer blade holding member 91, first net blade 35*a*, slit blade 35*b*, and second net blade 35*c* are disposed in order from the front side in the front-and-back direction X so as to be exposed upward.

These outer blades 35 can be mounted on outer blade holding member 91 in an upwardly and downwardly movable manner by the following method, for example.

First, an outer blade cassette is formed by mounting respective outer blades 35 on an outer blade frame having an approximately frame shape such that respective outer blades 35 are separately and independently movable in the up-and-down direction. Note that, any known outer blade frame and outer blade cassette can be used.

Then, the outer blade cassette is inserted into the inside of outer blade holding member 91 having an approximately cylindrical shape from below in a state where respective outer blades 35 are directed upward, and the outer blade frame is made to engage with outer blade holding member 91.

With such a configuration, respective outer blades 35 can be mounted on outer blade holding member 91 in a separately and independently movable manner in the up-and-down direction.

The outer blade cassette is detachably mounted on outer blade holding member 91 and is also detachably mounted on head portion body 80.

Net blades 35*a*, 35*c* are each formed by bending one sheet of an approximately plate-like member into an inverted U shape along the front-and-back direction (lateral direction) X such that net blades 35*a*, 35*c* project upwardly as viewed in a side view (in a state where the outer blades are viewed in the right-and-left direction Y). Further, net blades 35*a*, 35*c* are formed to bend slightly along the right-and-left direction (longitudinal direction) Y such that net blades 35*a*, 35*c* project upward as viewed in a front view (in a state where the outer blades are viewed in the front-and-back direction X). In the exemplary embodiment, net blades 35*a*, 35*c* are bent such that net blades 35*a*, 35*c* project upward as viewed in a front view. However, it is not always necessary that net blades 35*a*, 35*c* are formed in a bending manner.

A large number of blade holes (not shown) are formed in each of net blades 35*a*, 35*c*.

On the other hand, slit blade 35*b* is formed by folding one sheet of an approximately plate-like member along the front-and-back direction (lateral direction) X, and a large number of slits (blade holes) are formed in slit blade 35*b* such that the slits extend from a flat upper wall to side walls of slit blade 35*b*.

That is, a large number of slits (blade holes) are formed in slit blade 35*b* by crosspieces extending from the flat upper wall to the side walls of slit blade 35*b* and crosspieces extending along the longitudinal direction (right-and-left direction) Y on a lower portion of the side walls of slit blade 35*b*.

Inner blades 34 are used dedicatedly for respective net blades 35*a*, 35*c* and slit blade 35*b* which form outer blades 35. To be more specific, below (inside) respective net blades 35*a*, 35*c*, inner blades (first inner blade 34*a*, second inner blade 34*c*) having an inverted U shape which are formed along a bent shape of corresponding net blades 35*a*, 35*c* are disposed (see FIG. 2). On the other hand, below (inside) slit blade 35*b*, a slit inner blade (not shown) having a shape formed along a folding shape of slit blade 35*b* is disposed.

These inner blades 34 are mounted on the drive mechanism. When the drive mechanism is driven, respective inner blades 34 are reciprocated in the right-and-left direction (longitudinal direction) Y.

In the exemplary embodiment, first inner blade 34*a*, second inner blade 34*c* and the slit inner blade (not shown) are mounted on the drive mechanism in a separately and independently movable manner in the up-and-down direction. Respective inner blades 34 are disposed below corresponding outer blades 35 such that inner blades 34 are brought into slide contact inner surfaces of outer blades 35 when the respective inner blades 34 are moved in a reciprocating manner in the right-and-left direction (longitudinal direction) Y.

In this manner, by moving first inner blade 34*a*, second inner blade 34*c* and the slit blade (not shown) respectively disposed below (inside) first net blade 35*a*, second net blade 35*c* and slit blade 35*b* relative to respective outer blades 35 (in a reciprocating manner in the right-and-left direction Y), outer blades 35 can cut body hair which enter the blade holes of respective outer blades 35 and the slits in cooperation with corresponding inner blades 34.

Release buttons 80*a* are disposed on both right and left ends of head portion body 80 in an extendible and retractable manner in the right-and-left direction Y. By making release buttons 80*a* retract inward, mounting of outer blade block 90 and head portion body 80 is released.

When outer blade block 90 is mounted on head portion body 80, a space portion is formed in an upper portion of head case cover 83 so that body hair shaved by blade portion 33 can be accumulated.

Figure 3:
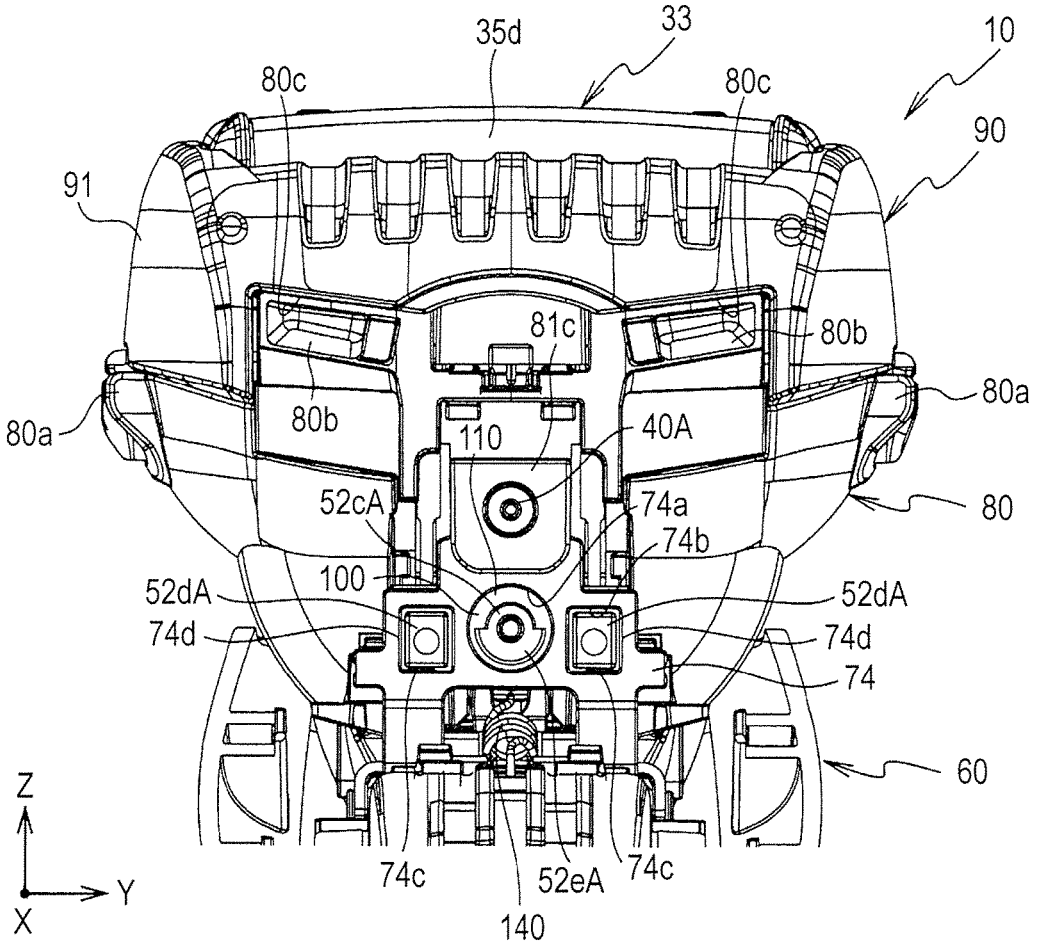
FIG. 3 is a front view showing a head portion of the electric shaver according to the exemplary embodiment of the present disclosure in an enlarged manner in a state where a front housing is removed.

Further, window portions 80*c* which allows the space portion to communicate with an outer space are formed on a front portion of head portion 30 (see FIG. 3). Window portions 80*c* function as introducing ports for introducing water into the inside of the space portion at the time of washing away body hair accumulated in the space portion or as discharge ports for discharging body hair and water in the space portion.

Shutters (lid portions) 80*b* which cover window portions 80*c* in an openable and closeable manner are mounted on a front portion of head portion 30 in an upwardly and downwardly slidable manner.

Figure 4:
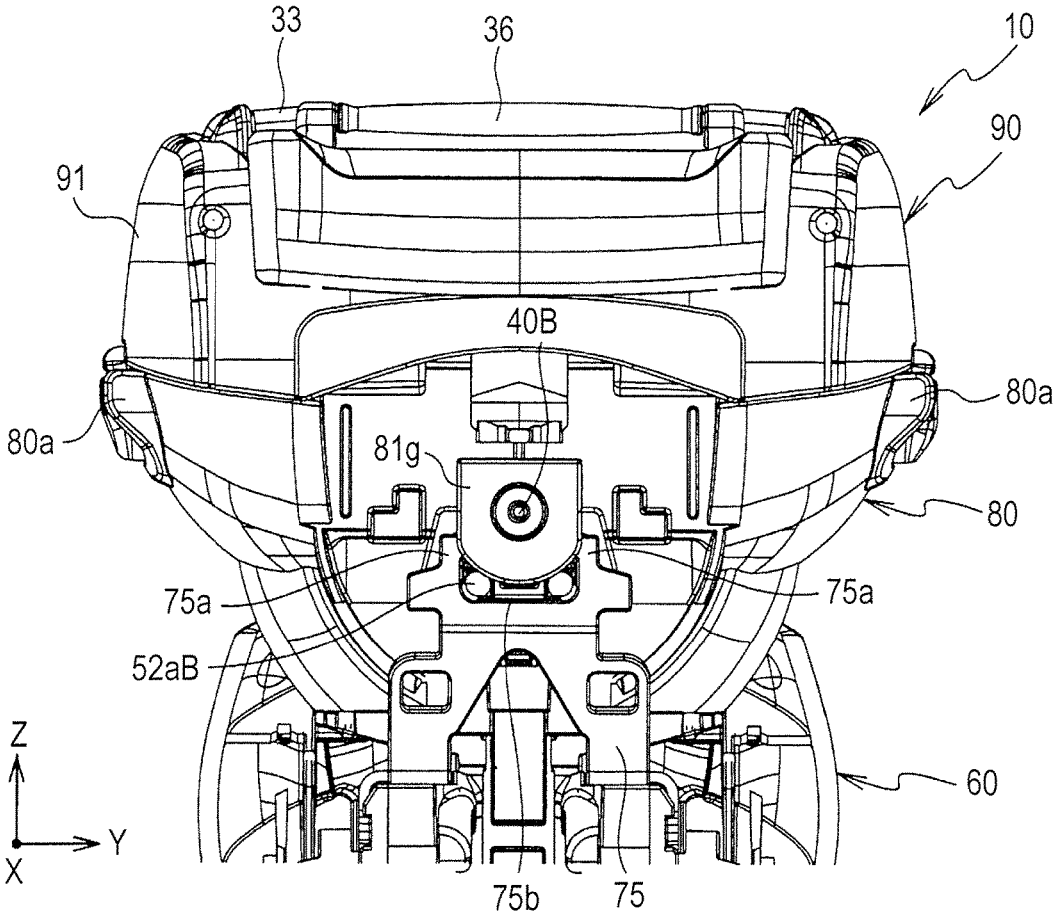
FIG. 4 is a back view showing the head portion of the electric shaver according to the exemplary embodiment of the present disclosure in an enlarged manner in a state where a rear housing is removed.

Rotary member 36 is mounted on a rear portion of outer blade holding member 91 (see FIG. 4). Rotary member 36 is brought into contact with a skin and rotates when blade portion 33 shaves body hair to thus reduce a friction between a skin surface and electric shaver 1.

In the exemplary embodiment, as shown in FIG. 3 and FIG. 4, body block 20 and head portion 30 are connected to each other by way of connecting member 50.

That is, one end (lower side) of connecting member 50 is connected to body block 20, and the other end (upper side) of connecting member 50 is connected to head portion 30.

With such a configuration, connecting member 50 is movable relative to body block 20 in the intersecting direction (direction along a Y-Z plane) which intersects with the extending direction (front-and-back direction X) of shaft portion 40.

Further, connecting member 50 is connected to head portion 30 by way of shaft portions 40, and head portion 30 swings about shaft portions 40 in the right-and-left direction with respect to connecting member 50.

In the exemplary embodiment, connecting member 50 is connected to holder member 72 of base portion 70 which forms a portion of body block 20, and connecting member 50 is also connected to head case 81 which forms a portion of head portion 30 (see FIG. 5 to FIG. 8).

Connecting member 50 includes front connecting member 50A, and rear connecting member 50B which is formed separately from front connecting member 50A. Front connecting member 50A and rear connecting member 50B are connected to holder member 72 (body block 20) and head case 81 (head portion 30), respectively.

In the exemplary embodiment, shaft portions 40 which are formed separately from head portion 30 and connecting member 50 are used, and these shaft portions 40 are formed of front shaft portion 40A and rear shaft portion 40B which is formed separately from front shaft portion 40A.

Figure 7:
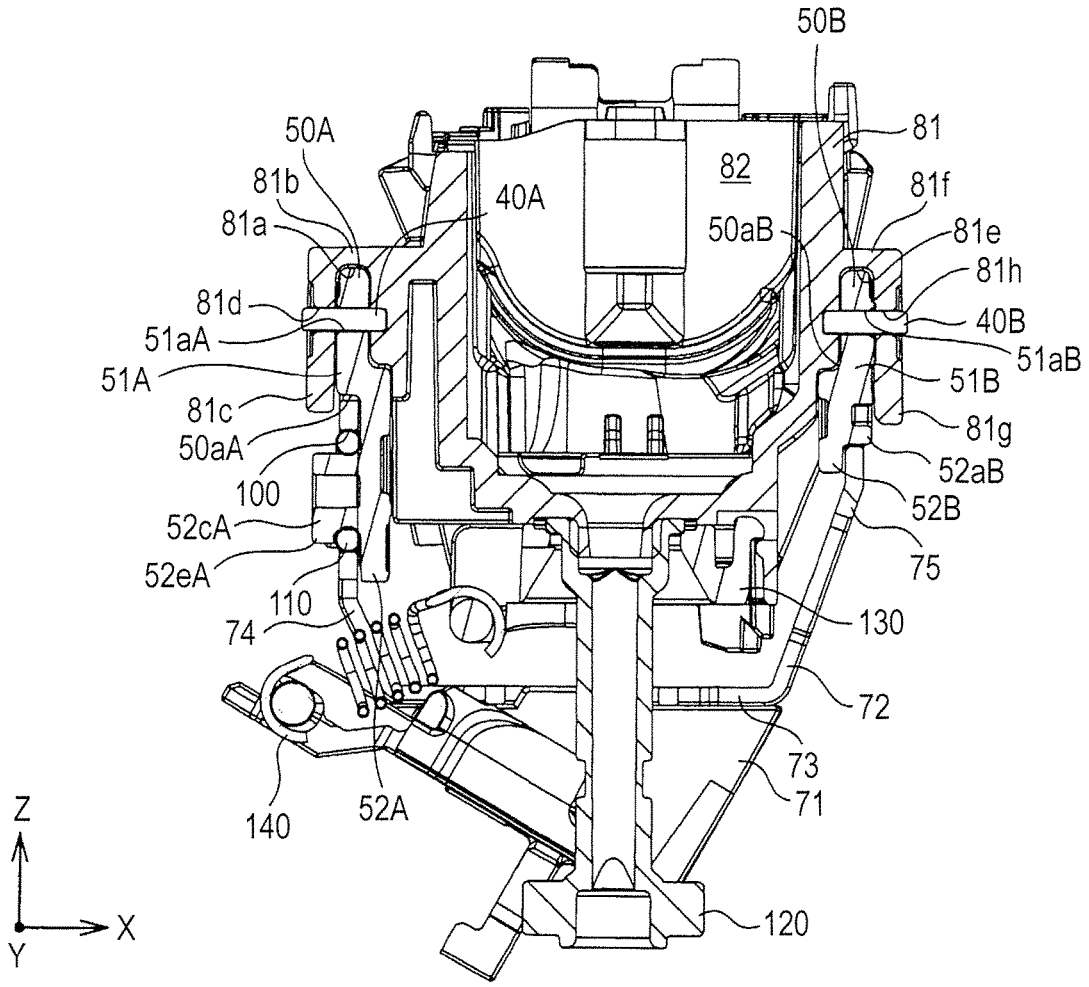
FIG. 7 is a cross-sectional view taken along a line 7-7 in FIG. 6.

Front connecting member 50A is connected to a front portion of head case 81 by way of front shaft portion 40A, and rear connecting member 50B is connected to a rear portion of head case 81 by way of rear shaft portion 40B (see FIG. 7).

To be mo specific, on a front portion of head case 81, front insertion groove 81*a* which opens downward is formed by front projecting lug 81*b* which projects frontward and front extending lug 81*c* which extends downward from a front end of front projecting lug 81*b* (see FIG. 7).

Figure 5:
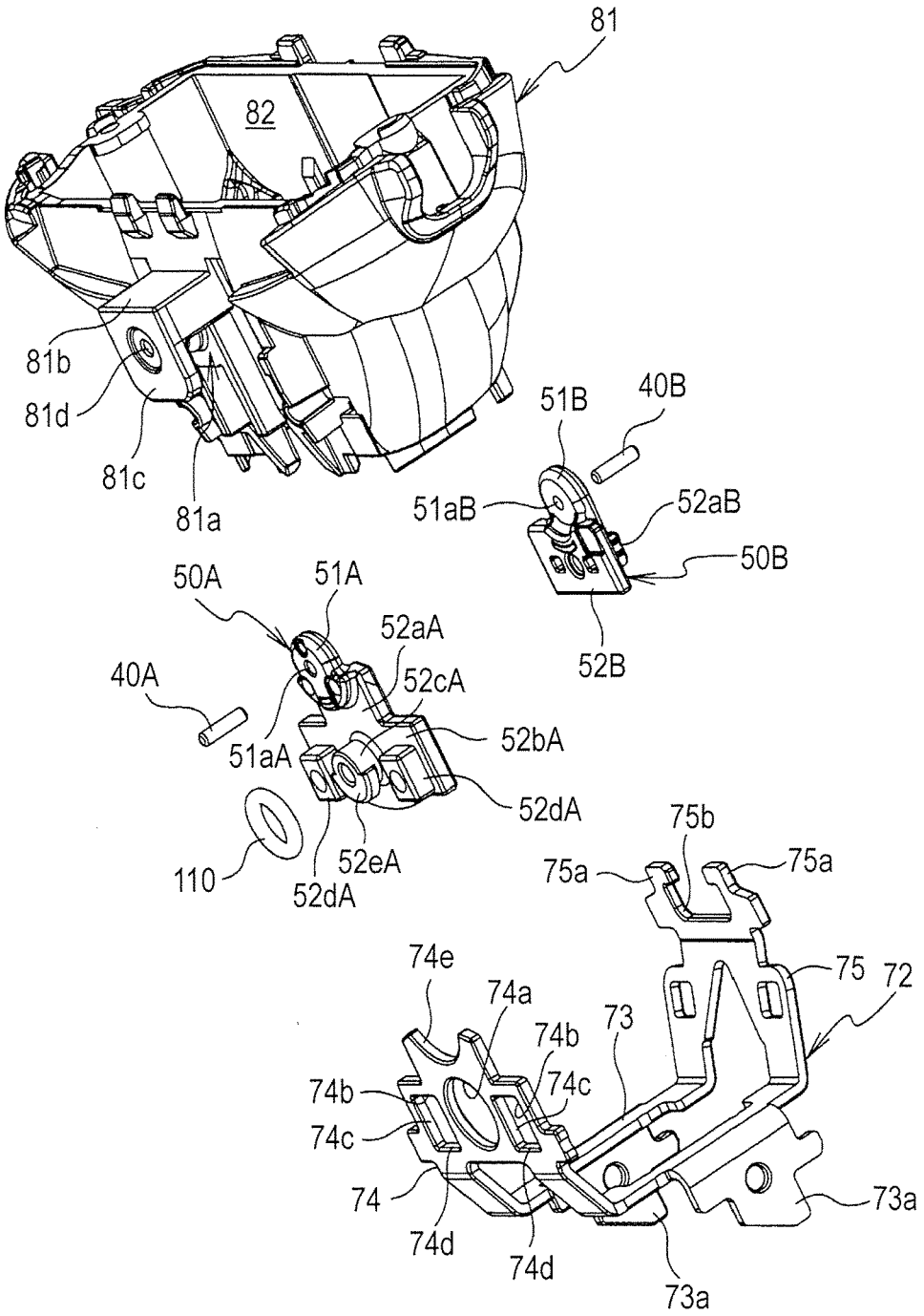
FIG. 5 is an exploded perspective view showing a drive mechanism housing case, a shaft portion, a connecting member, a resilient member, and a holder member according to the exemplary embodiment of the present disclosure.

On an upper portion of front connecting member 50A, shaft insertion hole 51*a*A. through which front shaft portion 40A is inserted is formed, and head-portion-side connecting portion 51A which is inserted into front insertion groove 81*a* is also formed (see FIG. 5). In the exemplary embodiment, head-portion-side connecting portion 51A has an approximately disc shape, and shaft insertion hole 51*a*A is formed in a center portion of head-portion-side connecting portion 51A.

In a state where head-portion-side connecting portion 51A is inserted into front insertion groove 81*a* from below and shaft insertion hole 51*a*A is made to communicate with shaft insertion hole 81*d* formed in front extending lug 81*c*, front shaft portion 40A is inserted into shaft insertion hole 51*a*A and shaft insertion hole 81*d*. With such a configuration, front connecting member 50A is connected to a front portion of head case 81 by way of front shaft portion 40A.

On the other hand, on the rear portion of head case 81, rear insertion groove 81*e* which opens downward is formed. Rear insertion groove 81*e* is formed by rear projecting lug 81*f* which projects rearward and rear extending lug 81*g* which extends downward from a rear end of rear projecting lug 81*f* (see FIG. 7).

On an upper portion of rear connecting member 50B, shaft insertion hole 51*a*B through which rear shaft portion 40B is inserted is formed, and head-portion-side connecting portion 51B which is inserted into rear insertion groove 81*e* is also formed (see FIG. 5). In the exemplary embodiment, head-portion-side connecting portion 51B has an approximately disc shape, and shaft insertion hole 51*a*B is formed in a center portion of head-portion-side connecting portion 51B.

In a state where head-portion-side connecting portion 51B is inserted into rear insertion groove 81*e* from below and shaft insertion hole 51*a*B is made to communicate with shaft insertion hole 81*h* formed in rear extending lug 81*g*, rear shaft portion 40B is inserted into shaft insertion hole 51*a*B and shaft insertion hole 81*h*. With such a configuration, rear connecting member 50B is connected to the rear portion of head case 81 by way of rear shaft portion 40B.

Base portion 70 includes: base body 71 which is fixed to one end side (upper side in the up-and-down direction Z) of gripping portion 60; and holder member 72 which is mounted on base body 71 and to which connecting members 50 (front connecting member 50A and rear connecting member 50B) are connected.

Base body 71 is mounted on gripping portion 60, and has a triangular shape such that an upper portion of base body 71 forms an inclined lug which is inclined frontward and downward as viewed in the right-and-left direction Y in a state where the longitudinal direction of gripping portion 60 is directed in the vertical direction. Holder member 72 is mounted on an upper portion of base body 71, that is, on inclined surface 71*a* which is inclined frontward and downward (see FIG. 2 and FIG. 8).

Figure 8:
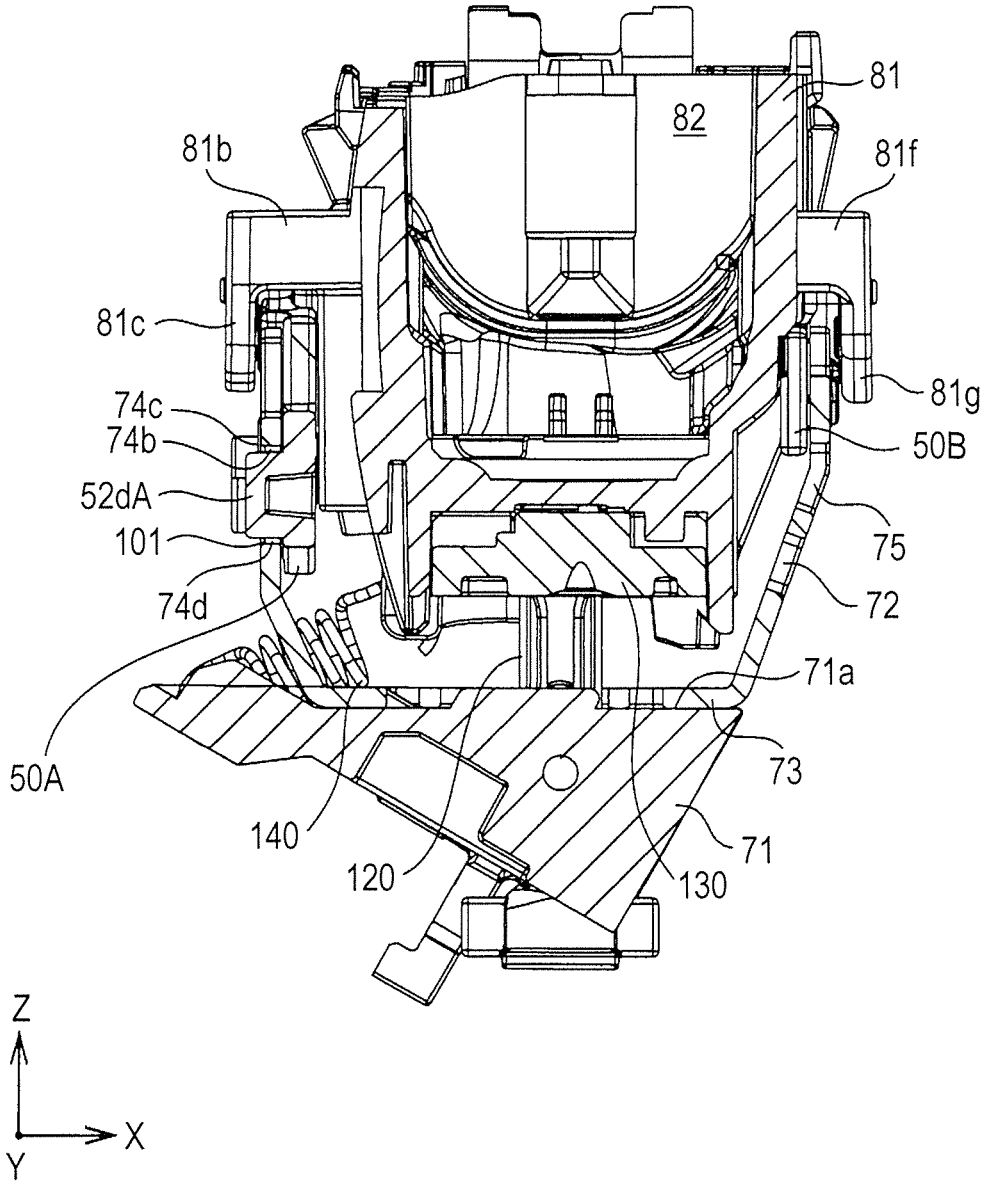
FIG. 8 is a cross-sectional view taken along a line 8-8 in FIG. 6.

In the exemplary embodiment, the direction perpendicular to inclined surface 71*a* is set as the up-and-down direction Z which is the up-and-down direction of head portion 30 (see FIG. 8). Accordingly, in the exemplary embodiment, head portion 30 is mounted on gripping portion 60 such that the upper portion of base body 71 is inclined frontward and downward as viewed in the right-and-left direction Y in a state where the longitudinal direction of gripping portion 60 is directed in the vertical direction.

Holder member 72 includes placing portion 73 which is placed on inclined surface 71*a* of base body 71, and mounting lug 73*a* which extends downward and rearward is formed on either end of placing portion 73 in the right-and-left direction Y (see FIG. 2 and FIG. 5).

By fixing right and left mounting lugs 73*a* to base body 71 using screws 73*b*, holder member 72 is mounted on base body 71 (see FIG. 2).

As shown in FIG. 5, holder member 72 includes: front connecting lug 74 which is continuously formed on a front end of placing portion 73 and extends frontward and upward; and rear connecting lug 75 which is continuously formed on a rear end of placing portion 73 and extends rearward and upward.

Front connecting member 50A is connected to front connecting lug 74, and rear connecting member 50B is connected to rear connecting 1 see FIG. 7).

To be more specific, body-block-side connecting portion 52A is formed on a lower portion of front connecting member 50A. Body-block-side connecting portion 52A has an approximately plate shape, and is formed on a lower rear portion of head-portion-side connecting portion 51A. In other words, stepped portion 50*a*A where head-portion-side connecting portion 51A projects frontward is formed on front connecting member 50A at a connecting portion between head-portion-side connecting portion 51A and body-block-side connecting portion 52A as viewed in the right-and-left direction Y (see FIG. 7).

Body-block-side connecting portion 52A includes: rectangular-shaped connecting portion 52*a*A which is continuously formed on a lower rear portion of head-portion-side connecting portion 51A, and rectangular-shaped large width portion 52*b*A which is formed below connecting portion 52*a*A and has a large width (see FIG. 5).

In the exemplary embodiment, approximately cylindrical first projecting portion 52*c*A which projects frontward is formed on a center portion of large width portion 52*b*A in the right-and-left direction Y, i.e., at a position which is just below shaft insertion hole 51*a*A into which front shaft portion 40A is inserted and is offset from shaft insertion hole 51*a*A.

Approximately circular-shaped first through hole 74*a* through which first projecting portion 52*c*A is inserted is formed in front connecting lug 74.

That is, in the exemplary embodiment, first projecting portion 52*c*A which projects in the front-and-back direction X (extending direction of shaft portion 40) is formed on connecting member 50 (front connecting member 50A), which is one of connecting member 50 and body block 20. First through hole 74*a* through which first projecting portion 52*c*A is inserted is formed in body block 20 (holder member 72), which is the other of connecting member 50 and body block 20, at a position corresponding to first projecting portion 52*c*A.

With such a configuration, the inner diameter of first through hole 74*a* is set larger than the outer diameter of first projecting portion 52*c*A. Thus, gap 100 which allows the relative movement of connecting member 50 (front connecting member 50A) to body block 20 (holder member 72) in the intersecting direction (direction along a Y-Z plane) is formed between connecting member 50 (front connecting member 50A) and body block 20 (holder member 72) as viewed in the front-and-back direction X (extending direction of shaft portion 40) in a state where connecting member 50 (front connecting member 50A) is connected to body block 20 (holder member 72).

Figure 6:
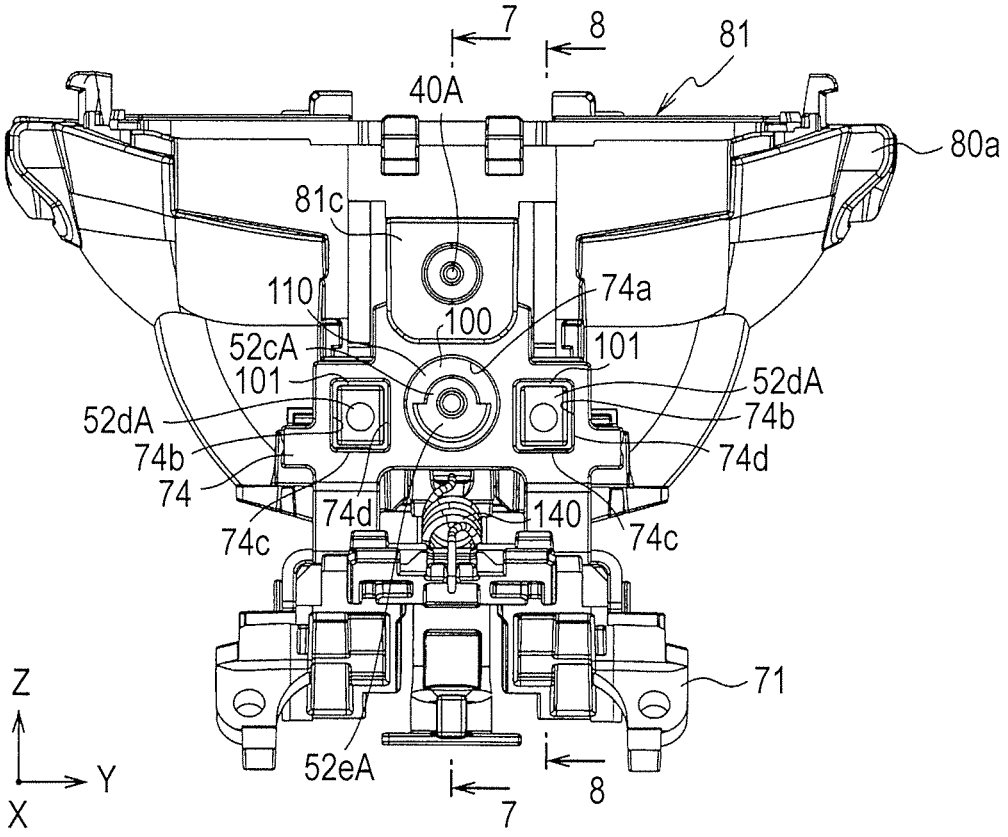
FIG. 6 is a front view showing a connection state where the drive mechanism housing case and a base portion according to the exemplary embodiment of the present disclosure are connected to each other.

Gap 100 is formed annularly around first projecting portion 52*c*A in a state where first projecting portion 52*c*A is inserted through first through hole 74*a* (see FIG. 6).

By disposing O ring (resilient member) 110 in gap 100, connecting member 50 (front connecting member 50A) is connected to body block 20 (holder member 72) by way of O ring 110.

As described above, connecting member 50 (front connecting member 50A) is connected to body block 20 (holder member 72) by way of O ring 110 and hence, rattling of connecting member 50 (front connecting member 50A) can be suppressed.

In the exemplary embodiment, O ring 110 is used as the resilient member and hence, O ring 110 is disposed over the entire circumference of gap 100 formed annularly.

In the exemplary embodiment, a semicircular-arcuate-shaped flange (removal preventing projection) 52*e*A which projects radially outward is formed on a lower portion of a front end of first projecting portion 52*c*A (see FIG. 5), and the removal of O ring 110 is prevented by flange 52*e*A.

In this manner, in the exemplary embodiment, the structure for absorbing positional displacement of front shaft portion 40A is formed just below front shaft portion 40A which is liable to be easily displaced in the up-and-down direction (at a position displaced downward in the up-and-down direction Z from front shaft portion 40A).

Further, in the exemplary embodiment, second projecting portion 52*d*A which has an approximately quadrangular prism shape and projects frontward is formed on either side of first projecting portion 52*c*A formed on large width portion 52*b*A in the right-and-left direction Y.

That is, as viewed in the front-and-back direction X (extending direction of shaft portion 40), second projecting portion 52*d*A is disposed on either side of O ring 110.

Approximately rectangular-shaped second through holes 74*b* through which second projecting portions 52*d*A are inserted respectively are formed in front connecting lug 74.

That is, in the exemplary embodiment, second projecting portions 52*d*A which project in the front-and-back direction X (extending direction of shaft portion 40) are formed on connecting member 50 (front connecting member 50A), which is one of connecting member 50 and body block 20. Second through holes 74*b* through which second projecting portions 52*d*A are inserted are formed in body block 20 (holder member 72), which is the other of connecting member 50 and body block 20, at positions corresponding to second projecting portions 52*d*A.

In such a configuration, second through hole 74*b* is set one size larger than second projecting portion 52*d*A so that gap 101 is formed annularly around second projecting portion 52*d*A.

The size of gap 101 (a distance from a peripheral surface of second projecting portion 52*d*A to an inner peripheral surface of second through hole 74*b* in a state where second projecting portion 52*d*A is inserted through the center of second through hole 74*b*) is set smaller than the size of gap 100 (a distance from a peripheral surface of first projecting portion 52*c*A to an inner peripheral surface of first through hole 74*a* in a state where first projecting portion 52*c*A is inserted through the center of first through hole 74*a*) (see FIG. 6).

In this case, it is preferable to set the size of gap 101 such that, when connecting member 50 (front connecting member 50A) moves relative to body block 20 (holder member 72) in the intersecting direction (the direction along the Y-Z plane) due to size tolerance or the like, second projecting portion 52*d*A is not brought into contact with peripheral edge portion 74*c* of second through hole 74*b*.

There may be a case where a relatively large force is applied to head portion 30 due to an impact generated when electric shaver 10 is dropped or the like, so that connecting member 50 (front connecting member 50A) moves relative to body block 20 (holder member 72) in the intersecting direction (the direction along the Y-Z plane). In such a case, it is preferable that the size of gap 101 be set such that second projecting portion 52*d*A is brought into contact with peripheral edge portion 74*c* of second through hole 74*b* in a state where first projecting portion 52*c*A is movable relative to body block 20 (holder member 72) in the intersecting direction (the direction along the Y-Z plane).

As described above, in the exemplary embodiment, contact portion 74*d* with which second projecting portion 52*d*A is brought into contact when connecting member 50 (front connecting member 50A) is moved relative to body block 20 (holder member 72) in the intersecting direction (the direction along the Y-Z plane) is formed on peripheral edge portion 74*c* of second through hole 74*b*.

Front connecting member 50A having the above-mentioned shape can be mounted on front connecting lug 74 of holder member 72 by the following method, for example.

First, O ring 110 is mounted on first projecting portion 52*c*A. Then, in a state where O ring 110 is mounted on first projecting portion 52*c*A, first projecting portion 52*c*A is inserted into first through hole 74*a* and, at the same time, the pair of second projecting portions 52*d*A is inserted into corresponding second through holes 74*b* from the rear side respectively. At this time, front connecting member 50A is pushed until O ring 110 is disposed in gap 100 formed between the peripheral surface of first projecting portion 52*c*A and the inner peripheral surface of first through hole 74*a*. With such an operation, front connecting member 50A is connected to front connecting lug 74 of holder member 72. Semicircular-arc-shaped recessed portion 74*e* is formed on a center portion of an upper portion of front connecting lug 74 in the right-and-left direction Y, and head-portion-side connecting portion 51A of front connecting member 50A is placed on recessed portion 74*e*.

Body-block-side connecting portion 52B is formed on a lower portion of rear connecting member 50B. Body-block-side connecting portion 52B has an approximately plate shape, and is continuously mounted on a lower front portion of head-portion-side connecting portion 51B. That is, as viewed in the right-and-left direction Y, stepped portion 50*a*B where head-portion-side connecting portion 51B projects rearward is formed on rear connecting member 50B at a connecting portion between head-portion-side connecting portion 51B and body-block-side connecting portion 52B (see FIG. 7).

Engaging projecting portion 52*a*B having an approximately quadrangular prism shape which projects rearward is formed on a center portion of body-block-side connecting portion 52B in the right-and-left direction Y.

Engaging hole 75*b* with which engaging projecting portion 52*a*B is engageable is formed in rear connecting lug 75. To be more specific, engaging hole 75*b* with which engaging projecting portion 52*a*B is engageable is formed in rear connecting lug 75 by forming a pair of engaging lugs 75*a* which extends upward from both sides of rear connecting lug 75 in the right-and-left direction Y and has distal ends thereof projecting inward in the right-and-left direction Y.

By making engaging projecting portion 52*a*B engage with engaging hole 75*b*, rear connecting member 50B is connected to rear connecting lug 75.

In this case, rear connecting member 50B is connected to rear connecting lug 75 in a state where the relative movement of rear connecting member 50B to body block 20 (holder member 72) in the intersecting direction (the direction along the Y-Z plane) is suppressed.

That is, allowance of relative movement of rear connecting member 50B to body block 20 (holder member 72) in the intersecting direction (the direction along the Y-Z plane) is set smaller than allowance of relative movement of front connecting member 50A to body block 20 (holder member 72) in the intersecting direction (the direction along the Y-Z plane).

It is also possible to prevent the relative movement of rear connecting member 50B to body block 20 (holder member in the intersecting direction (the direction along the Y-Z plane) by making engaging projecting portion 52*a*B engage with engaging hole 75*b* by fitting engagement.

In the exemplary embodiment, wire tube 120 is fixed to a lower portion of head case 81 by wire tube pressing member 130 (see FIG. 7). Further, wire tube pressing member 130 and base body 71 are connected to each other by tension spring 140. By connecting wire tube pressing member 130 and base body 71 to each other by tension spring 140 in this manner, it is possible to return head portion 30 to a neutral position.

With such a configuration, head portion 30 is supported on body block 20 in a state where the center axis of front shaft portion 40A and the center axis of rear shaft portion 40B are positioned on substantially the same straight line and hence, head portion 30 can be swung relative to body block 20 more smoothly.

As has been described above, electric shaver 10 according to the exemplary embodiment includes: body block 20 having holding portion 60*a;* head portion 30 having blade portion 33 and swingably supported on body block 20 about shaft portion 40; and connecting member 50 which connects body block 20 and head portion 30 to each other. To be more specific, connecting member 50 is connected to body block 20 such that the relative movement of connecting member 50 in the intersecting direction which intersects with the extending direction of shaft portion 40 is allowed, and is connected to head portion 30 by way of shaft portions 40.

Connecting member 50 is connected to body block 20 by way of O ring 110.

With such a configuration, even when a reaction force caused by axial displacement is generated, the reaction force can be absorbed by the relative movement of connecting member 50 to body block 20 in the intersecting direction. Further, connecting member 50 is connected to body block 20 by way of O ring 110 and hence, the generation of abnormal sounds and vibrations can be suppressed at the time of driving electric shaver 10 or the like.

As has been described above, according to the exemplary embodiment, it is possible to provide electric shaver 10 capable of suppressing the generation of abnormal sounds and vibrations while suppressing lowering of a swing performance.

In a state where connecting member 50 is connected to body block 20, as viewed in the extending direction of shaft portion 40, gap 100 which allows the relative movement of connecting member 50 to body block 20 in the intersecting direction is formed between connecting member 50 and body block 20. O ring 110 is disposed in gap 100.

With such a configuration, it is possible to suppress rattling of connecting member 50 more reliably while allowing the relative movement of connecting member 50 to body block 20 in the intersecting direction.

First projecting portion 52*c*A which projects in the extending direction of shaft portion 40 is formed on one of connecting member 50 and body block 20, and first through hole 74*a* through which first projecting portion 52*c*A is inserted is formed on the other of connecting member 50 and body block 20, at a position corresponding to first projecting portion 52*c*A.

In a state where first projecting portion 52$c$A is inserted through first through hole 74$a$, gap 100 is formed annularly around first projecting portion 52$c$A.

With such a configuration, it is possible to allow the relative movement of connecting member 50 to body block 20 in any arbitrary intersecting direction (an arbitrary direction on the Y-Z plane).

O ring 110 is disposed over the entire circumference of gap 100 formed annularly.

With such a configuration, it is possible to suppress rattling of connecting member 50 more reliably while allowing the relative movement of connecting member 50 to body block 20 in an arbitrary intersecting direction (an arbitrary direction on the Y-Z plane).

Second projecting portions 52$d$A which project in the extending direction of shaft portion 40 are formed on one of connecting member 50 and body block 20, and second through holes 74$b$ through which second projecting portions 52$d$A are inserted are formed on the other of connecting member 50 and body block 20, at positions corresponding to second projecting portions 52$d$A.

Contact portion 74$d$ with which second projecting portion 52$d$A is brought into contact when connecting member 50 is moved relative to body block 20 in the intersecting direction is formed on peripheral edge portion 74$c$ of second through hole 74$b$.

With such a configuration, when a relatively large force is applied to head portion 30 due to an impact generated when electric shaver 10 is dropped or the like, for example, a reaction force generated on connecting member 50 can be dispersed to plural portions, thus reducing a load to the shaft portion disposed between head portion 30 and connecting member 50.

As viewed in the extending direction of shaft portion 40, second projecting portion 52$d$A is disposed on either side of O ring 110.

With such a configuration, it is possible to provide the structure for suppressing rattling of connecting member 50 using O ring 110 anal the structure for dispersing a reaction force using second projecting portions 52$d$A, while saving a space for such structures.

In a state where second projecting portion 52$d$A is inserted through second through hole 74$b$, gap 101 is formed around second projecting portion 52$d$A.

The size of second gap 101 is set smaller than the size of first gap 100.

Although the preferred exemplary embodiment of the present disclosure has been described heretofore, the present disclosure is not limited to the above-mentioned exemplary embodiment, and various modifications are conceivable.

For example, it is not always necessary to provide front connecting member 50A and rear connecting member 50B independently. Front connecting member 50A and rear connecting member 50B may be integrated with each other.

Front shaft portion 40A may be formed integrally with front connecting member 50A or head case 81. Rear shaft portion 40B may be formed integrally with rear connecting member 50B or head case 81.

Rear connecting lug 75 of holder member 72 may be directly connected to head case 81 by way of rear shaft portion 40B without using rear connecting member 50B.

Head portion 30 and gripping portion (body portion) 60 may be connected to each other by connecting member 50 without providing base portion 70.

Specifications (shape, size, layout and the like) of the blade portion, the body block and other detailed parts can be also suitably changed.

According to the present disclosure, it is possible to provide an electric shaver capable of suppressing the generation of abnormal sounds and vibrations while suppressing lowering of a swing performance.

What is claimed is:

1. An electric shaver comprising:

a body block having a holding portion;

a shaft portion;

a head portion having a blade portion and supported on the body block to be swingable about the shaft portion; and a connecting member provided for connecting the body block and the head portion to each other, wherein:

the connecting member is connected to the body block such that the connecting member is movable relative, as relative movement, to the body block in an intersecting direction which intersects with an longitudinal direction of the shaft portion, and the connecting member is also connected to the head portion via the shaft portion, the connecting member is connected to the body block via a resilient member, a first gap which allows the relative movement of the connecting member to the body block in the intersecting direction is formed between the connecting member and the body block as viewed in the longitudinal direction of the shaft portion in a state where the connecting member is connected to the body block, the resilient member is disposed in the first gap, a first projecting portion which projects in the longitudinal direction of the shaft portion is formed on the connecting member, and a first through hole through which the first projecting portion is inserted is formed on the body block, at a position corresponding to the first projecting portion, and the first gap is formed annularly around the first projecting portion in a state where the first projecting portion is inserted through the first through hole.

2. The electric shaver according to claim 1, wherein the resilient member has a ring shape and is disposed over an entire inner circumference of the first gap formed annularly.

3. The electric shaver according to claim 1, wherein a second projecting portion which projects in the longitudinal direction of the shaft portion is formed on the connecting member, and a second through hole through which the second projecting portion is inserted is formed on the body block, at a position corresponding to the second projecting portion, and a contact portion with which the second projecting portion is brought into contact when the connecting member is moved relative to the body block in the intersecting direction is formed on a peripheral portion of the second through hole.

4. The electric shaver according to claim 3, wherein the second projecting portion include two pieces of projecting portions disposed on both sides of the resilient member as viewed in the longitudinal direction of the shaft portion.

5. The electric shaver according to claim 3, wherein the second gap is formed around the second projecting portion in a state where the second projecting portion is inserted through the second through hole.

6. The electric shaver according to claim 5, wherein a size of the second gap is smaller than a size of the first gap.

* * * * *